US008468704B2

(12) United States Patent
Kennedy

(10) Patent No.: US 8,468,704 B2
(45) Date of Patent: Jun. 25, 2013

(54) BOW SIGHT LASER TUNING DEVICE

(76) Inventor: Mickey McArthur Kennedy, Medina, OH (US)

( * ) Notice: Subject to any disclaimer, the term of this patent is extended or adjusted under 35 U.S.C. 154(b) by 248 days.

(21) Appl. No.: 12/931,989

(22) Filed: Feb. 16, 2011

(65) Prior Publication Data

US 2012/0204433 A1 Aug. 16, 2012

(51) Int. Cl.
*F41G 1/467* (2006.01)

(52) U.S. Cl.
USPC ..... 33/265; 124/87

(58) Field of Classification Search
USPC ..... 33/228, 265, 286, DIG. 21; 124/87
See application file for complete search history.

(56) References Cited

U.S. PATENT DOCUMENTS

| | | | | |
|---|---|---|---|---|
| 5,419,050 | A * | 5/1995 | Moore | 33/DIG. 21 |
| 6,366,344 | B1 * | 4/2002 | Lach | 33/265 |
| 6,922,900 | B1 * | 8/2005 | Henry | 33/265 |
| 8,104,186 | B2 * | 1/2012 | Raschella et al. | 33/265 |
| 2004/0111899 | A1 * | 6/2004 | Humphries | 33/265 |
| 2012/0042528 | A1 * | 2/2012 | Edmundson | 33/228 |
| 2012/0210588 | A1 * | 8/2012 | Volpe | 33/265 |

* cited by examiner

*Primary Examiner* — G. Bradley Bennett

(57) ABSTRACT

The disclosed subject matter relates to an apparatus that can facilitate archery bow sight tuning by way of a laser light device. The apparatus can be mounted to a riser of a bow by way of a substantially arc-shaped mounting slot or aperture. Thus, the apparatus is not confined to a single configuration based upon a fixed location of mounting screws.

17 Claims, 5 Drawing Sheets

101
200
Ø .62
Ø .50
2X .03 X 45° CHAMFER
.38
.05
5/8-18 UNF-2A
202
3.0
KNURL SURFACE
SECTION A-A

.65
.35
204
.03 X 45° CHAMFER
R.03 MAX
Ø .385
200
A
A

BOW SIGHT LASER TUNING DEVICE

TECHNICAL FIELD

The present application relates generally to a laser tuning device and more particularly to a mechanism for tuning archery bow sights.

BACKGROUND

Due to the popularity of archery, a wide variety of mechanisms have evolved to aid the archer. Chief among these is, perhaps, a bow sight, which typically includes a housing for fiber-optic pins that can be aligned with a target when looking through a peep. In addition to the bow sight, archers sometimes utilize a laser light device for tuning the bow sights prior to actual use. Thus, once tuned, the archer can be assured that his or her sights are properly aligned.

A number of laser tuning devices exist on the market today. One such example of a prior art laser tuning device is provided in connection with graphical depiction 900 of FIG. 9. Graphical depiction 900 provides an example archery bow 902 to which an example bow sight 904 is attached. To this combination, prior art laser tuning device 906 is coupled for tuning bow sight 904. As can be seen, prior art laser tuning device 906 is attached to archery bow 902 by way of two fixed location screws 908. Hence, prior art laser tuning device 906 can be readily employed for tuning bow sight 904. However, such is the case because bow sight 904 has pins at the fore (front) section of archery bow 902, and a peep on the string (not shown) of archery bow sight 902.

Yet not all archery bow sights are configured as example archery bow sight 904. In fact, some bow sights utilize a peep that is coupled to a common frame utilized by the housing for the fiber-optic pins. For example, see U.S. Pat. No. 7,793,422. Appreciably, when employing the bow sight disclosed by U.S. Pat. No. 7,793,422, or any bow sight or bow that otherwise utilizes specific areas in the rear or aft portion of the bow, then conventional laser tuning devices, such as prior art laser tuning device 906 cannot be used for its desired purposes. This is so because conventional laser tuning devices can be mounted only in a fixed position, largely due to fixed locations of the mounting holes for screws 908. Thus, what is needed is a laser tuning device that can be utilized with a wider variety of bow sights and/or archery bows.

DETAILED DESCRIPTION

Figure 1A:
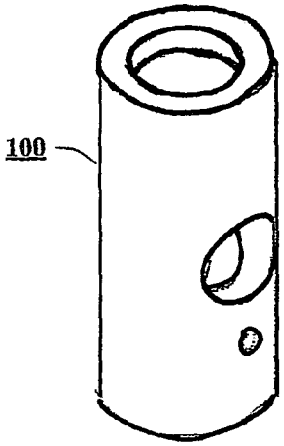
FIG. 1A is an example three-dimensional illustration of a laser housing adapted to house a laser light device.

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It may be evident, however, that the disclosed subject matter may be practiced without these specific details. In other instances, well-known structures and devices are shown in block diagram form in order to facilitate describing the disclosed subject matter.

As used herein, the word "exemplary" is used to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Referring now to the drawing, with reference initially to FIGS. 1A-1D, various views of example laser housing 100 are depicted. As used herein, laser housing 100 can also be referred to as laser barrel 100 or laser casing 100. Regardless, laser housing 100 can be adapted to house a laser light device, such as a laser pointer of any suitable construction or configuration. It is understood that laser casing 100, as with all or a portion of elements detailed herein, can be constructed out of any suitable material(s) that can be used in connection with molding, casting and so forth, such as, for example, aluminum, brass, plastic, or the like or derivations thereof.

Figure 1B:
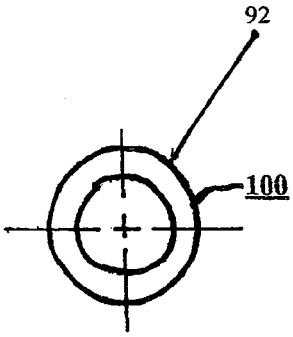
FIG. 1B is an example two-dimensional illustration of an axial view of the laser housing.
Figure 1C:
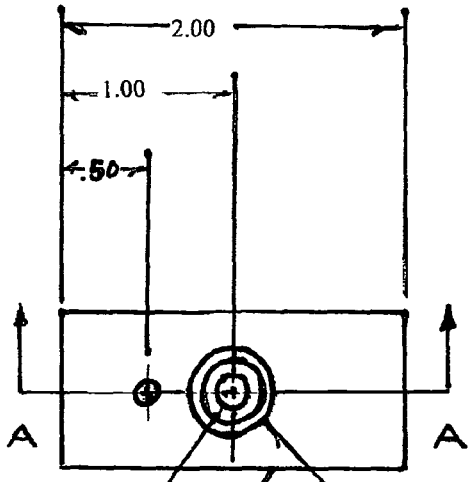
FIG. 1C is an example two-dimensional illustration of a side view of the laser housing, with a depicted cross-section.
Figure 1D:
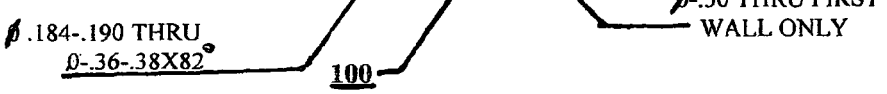
FIG. 1D is an example two-dimensional illustration of the depicted cross-section of the laser housing.
Figure 1D:
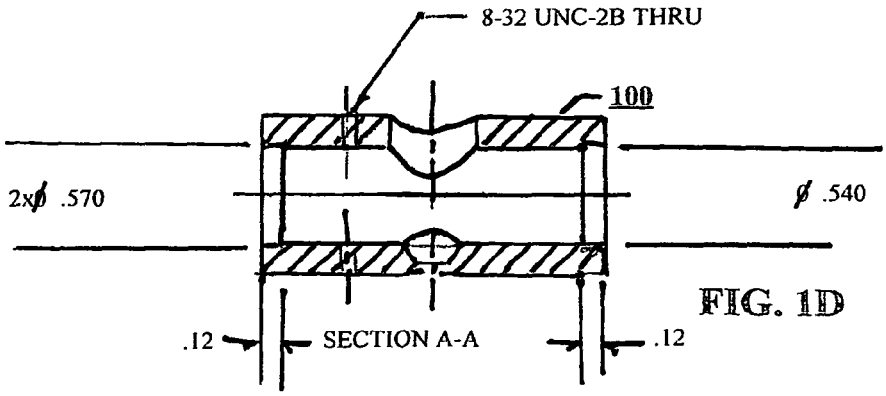

Specifically, FIG. 1A depicts an example three-dimensional illustration of laser housing 100 adapted to house a laser light device (not shown). FIG. 1B is an example two-dimensional illustration of an axial view of laser housing 100. Likewise, FIG. 1C is an example two-dimensional illustration of a side view of laser housing 100, with a depicted cross-section, whereas FIG. 1D is an example two-dimensional illustration of the depicted cross-section of laser housing 100.

It is understood that orthographic or schematic representations included herein are intended to be exemplary in nature, and are thus not necessarily intended to limit the appended claims. For example, specific dimensions, shapes, or proportions illustrated herein can represent one or more preferred embodiment, but other dimensions, shapes, or proportions can be employed as well.

Figures 2A, 2B:
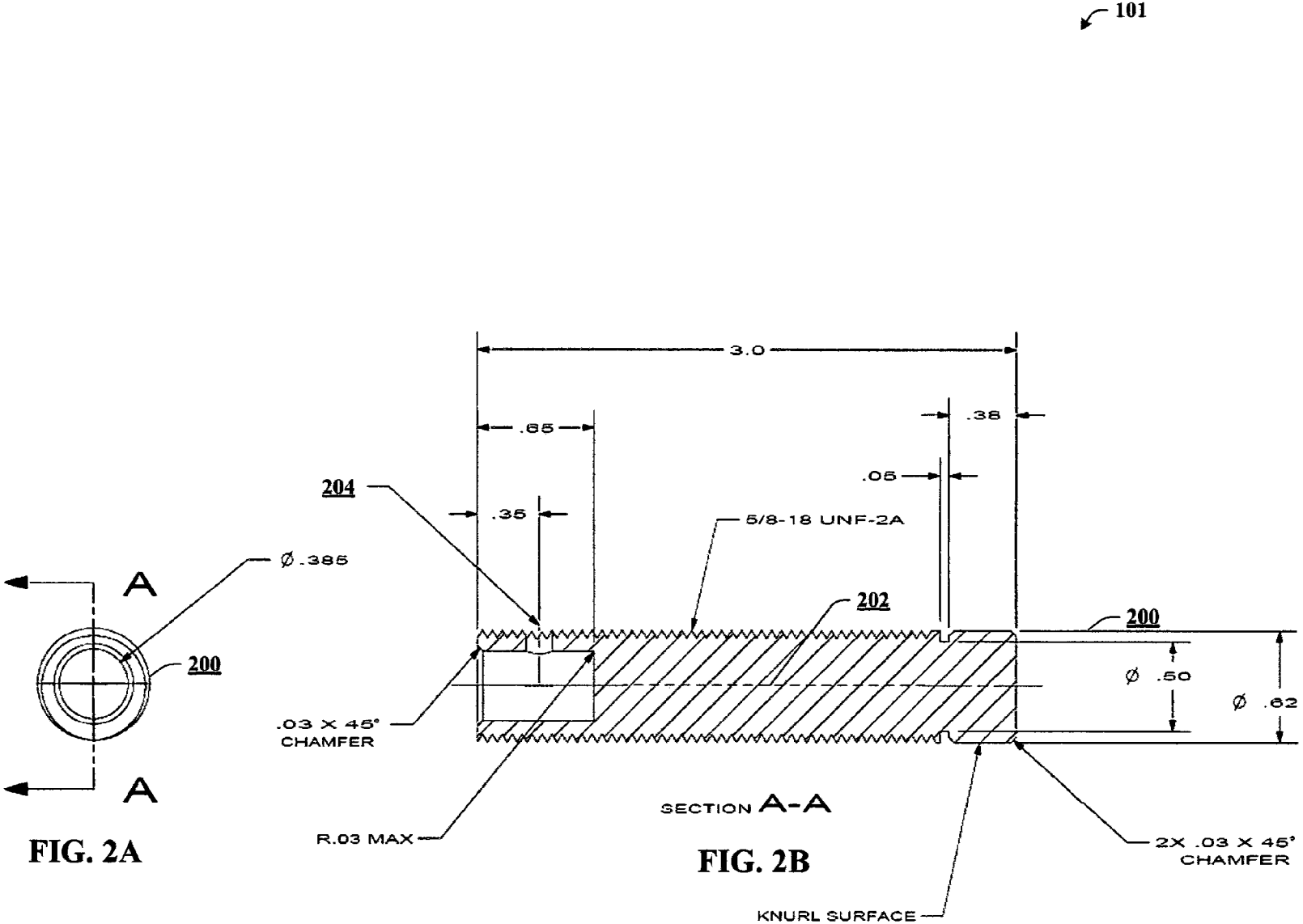
FIG. 2A is an example two-dimensional illustration of an axial view of an axis-adjusting bolt.
FIG. 2B is an example two-dimensional illustration of a side view of the axis-adjusting bolt.

Turning now to FIGS. 2A and 2B, various views of example axis-adjusting bolt 200 are illustrated. In particular, FIG. 2A is an example two-dimensional illustration of an axial view of axis-adjusting bolt 200. In addition, FIG. 2A includes a cross-section indicator, which is represented by FIG. 2B, illustrating a side view of the cross-section of axis-adjusting bolt 200. Axis-adjusting bolt 200 can be alternatively referred to as axis-adjusting rod 200 and can be coupled to laser housing 100, e.g., by way of a pivot arm (described in connection with FIGS. 3A-3C) or another suitable means. In one or more aspect, axis-adjusting bolt 200 can be a threaded bolt (as depicted).

In addition, in one or more aspect, axis-adjusting bolt 200 can be adapted to enable laser housing 100 to rotate up to 360 degrees along a rotation plane perpendicular to lateral axis 202 of axis-adjusting bolt 200, which is further detailed in connection with FIG. 5A. Furthermore, in one or more aspect, axis-adjusting bolt 200 can further include aperture 204. Aperture 204 can be configured for a set screw (not shown) or another suitable component, wherein the set screw is adapted to fix laser housing 100 at a particular angle in the rotation plane.

Figure 3A:
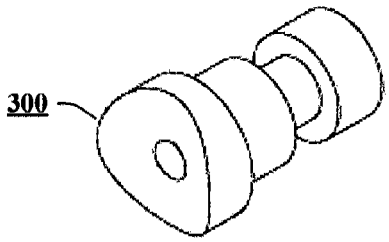
FIG. 3A is an example three-dimensional illustration of a pivot arm for coupling the laser housing to the axis-adjusting bolt.
Figure 3B:
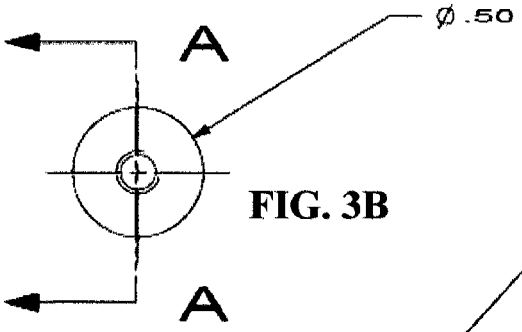
FIG. 3B is an example two-dimensional illustration of an axial view of the pivot arm with a depicted cross-section.
Figure 3C:
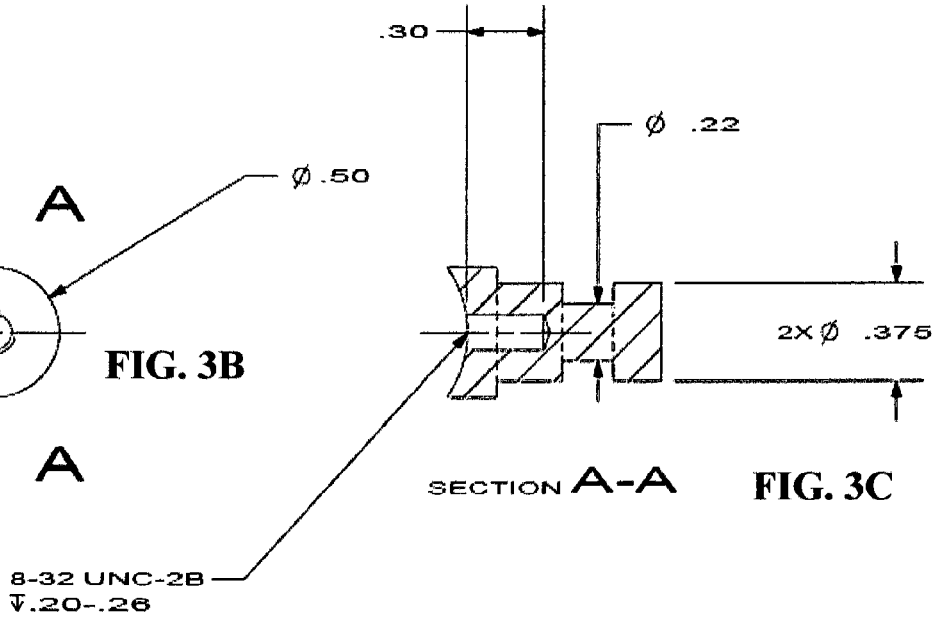
FIG. 3C is an example two-dimensional illustration of a side view of the depicted cross-section of the pivot arm.

With reference now to FIGS. 3A-3C, various views of example pivot arm 300 are provide. In particular, FIG. 3A is an example three-dimensional illustration of pivot arm 300 for coupling laser housing 100 to axis-adjusting bolt 200. FIG. 3B is an example two-dimensional illustration of an axial view of pivot arm 300 with a depicted cross-section. FIG. 3C is an example two-dimensional illustration of a side view of the depicted cross-section of pivot arm 300.

Figure 4C:
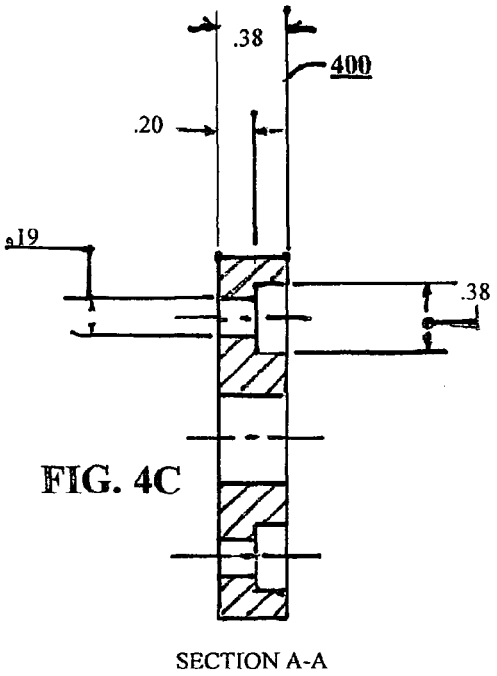
FIG. 4C is an example two-dimensional illustration of an axial view of the depicted cross-section of the mounting frame.
Figure 4A:
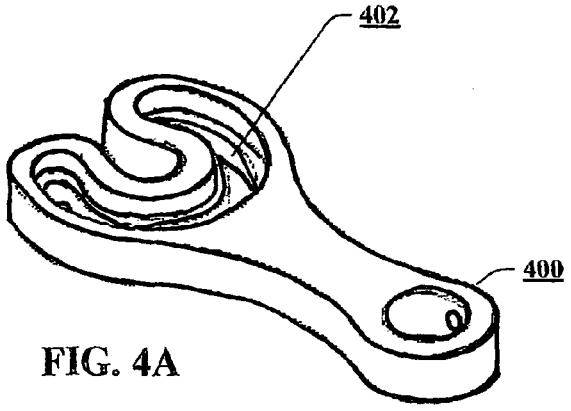
FIG. 4A is an example three-dimensional illustration of a mounting frame with a circular mounting slot.
Figure 4D:
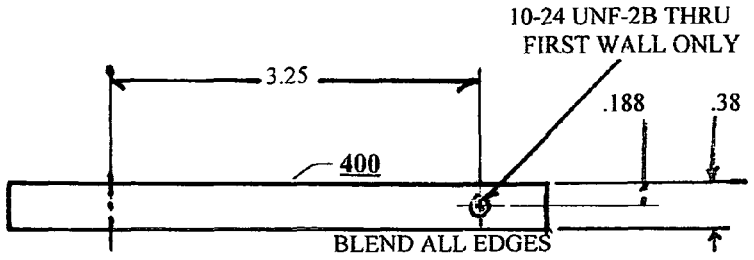
FIG. 4D is an example two-dimensional illustration of a side view of the mounting frame.
Figure 4B:
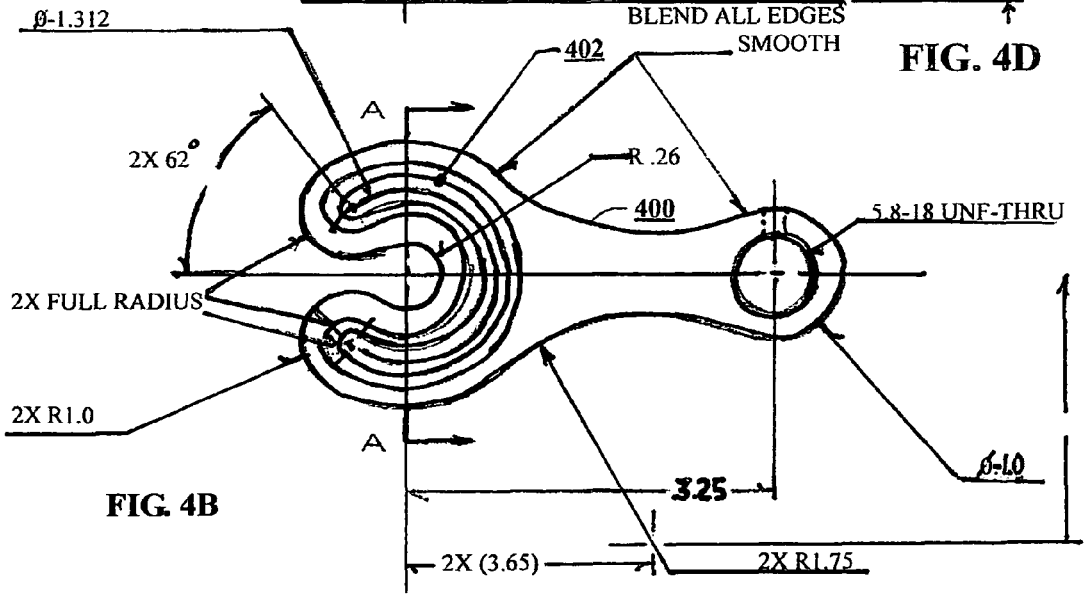
FIG. 4B is an example two-dimensional illustration of a top-down view of the mounting frame with a depicted cross-section.

Referring now to FIGS. 4A-4D, mounting frame 400 is depicted. Specifically, FIG. 4A is an example three-dimensional illustration of mounting frame 400 with arc-shaped mounting slot 402. Similarly, FIG. 4B is an example two-dimensional illustration of a top-down view of mounting frame 400 with a depicted cross-section, whereas, FIG. 4C is an example two-dimensional illustration of an axial view of the depicted cross-section of the mounting frame 400. Likewise, FIG. 4D is an example two-dimensional illustration of a side view of mounting frame 400.

Mounting frame 400 can be coupled to axis-adjusting bolt 200, thereby serving as a platform for which laser housing 100 can be mounted to an archery bow. As described in the Background section supra, one shortcoming of prior art bow sight tuning devices is that such devices are configured to be mounted in a set manner that cannot be varied due to a fixed location of mounting screw apertures. In contrast, rather than mounting to an archery bow by way of fixed-location apertures, as is the case with prior tuning devices, the disclosed subject matter can allow for variable mounting to accommodate a wider range of bow sights or bows.

To these and other related ends, mounting frame 400 can include arc-shaped mounting slot 402, which can also be referred to as circular mounting slot 402 or arc-shaped (or circular) mounting aperture 402. As depicted, arc-shaped mounting slot 402 can be substantially circular in shape. As such, mounting screws or other attachment means that connect to fixed locations on a bow need not restrict the angle of mounting frame 400, which can pivot due to arc-shaped mounting slot 402. Hence, mounting frame 400 can be attached to a bow according to many potential configurations, including mounting to the bow such that laser housing 100 is situated at a rear or aft portion of the bow as well as at a front or fore portion of the bow. In either case, mounting frame 400 can be perpendicular to a riser of the bow to which mounting frame 400 is mounted, or can be offset at various angles from perpendicular, e.g., to accommodate a wider variety of bow-bow sight configurations or permutations.

In one or more aspect, arc-shaped mounting slot 402 can span at least 200 degrees of an arc. In one or more preferred aspect, arc-shaped mounting slot 402 can be approximately or about 250 degrees (e.g., 250 degrees plus or minus 15 degrees) or exactly 250 degrees. Additionally or alternatively, in one or more aspect, arc-shaped mounting slot 402 can be configured to span an arc range of any angle between approximately 200 degrees to 300 degrees of a substantially circular shape, or can span a complete 360 degrees (e.g., a full circle aperture rather than an arc thereof).

Figure 5A:
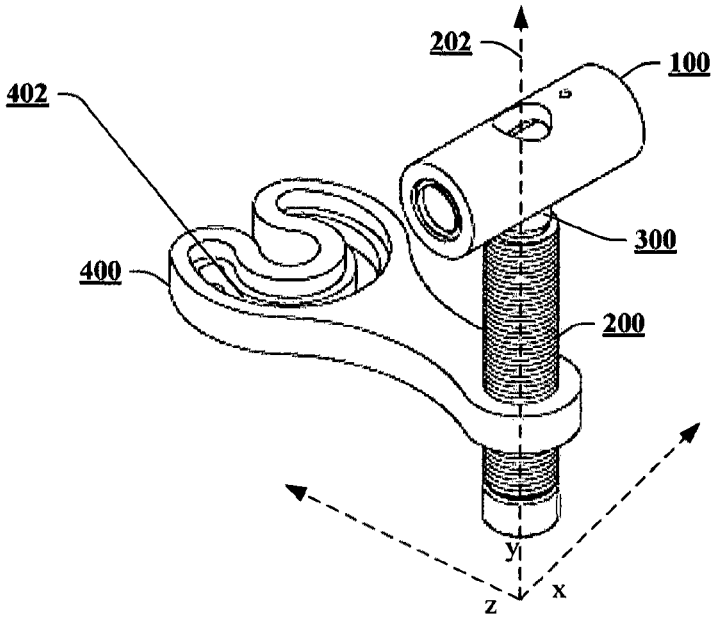
FIG. 5A depicts an example three-dimensional illustration of an apparatus that facilitates archery bow sight tuning.
Figure 5B:
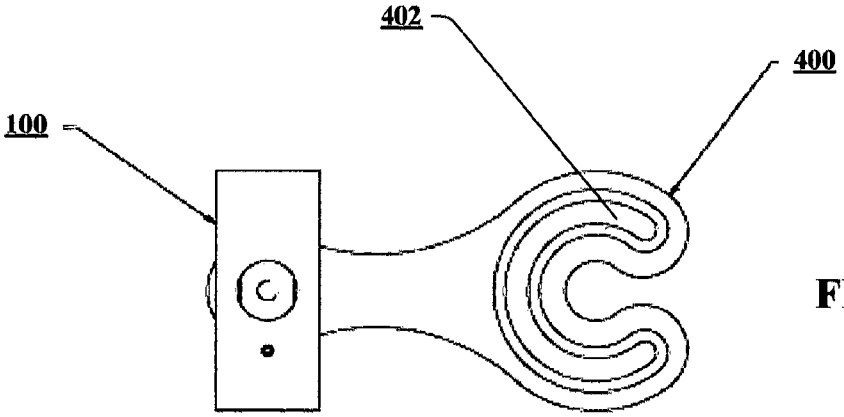
FIG. 5B depicts an example two-dimensional illustration of a top view of the apparatus.
Figure 5C:
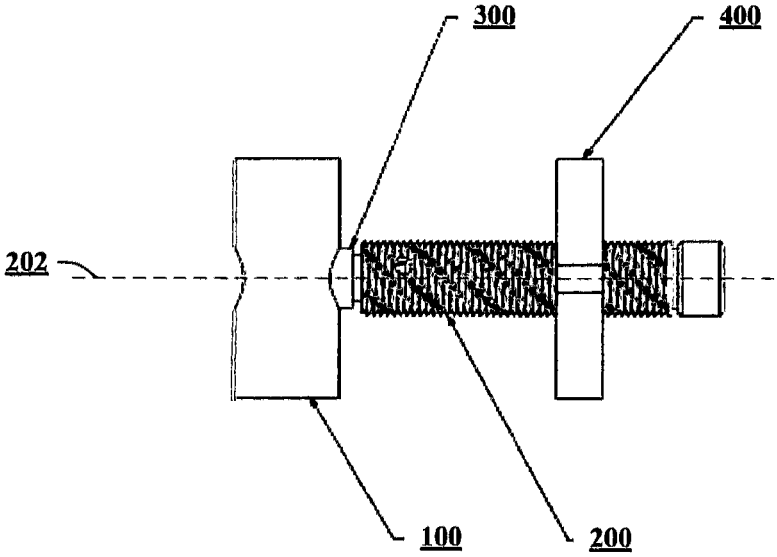
FIG. 5C depicts an example two-dimensional illustration of a side view of the apparatus.

With reference now to FIGS. 5A-5C, various views of an apparatus that accommodates a wider variety of archery bow sights and bows in connection with bow sight tuning are illustrated. In particular, FIG. 5A depicts an example three-dimensional illustration of the combined apparatus, which can include laser housing 100, axis-adjusting bolt 200, pivot arm 300, and mounting frame 400. FIG. 5B depicts an example two-dimensional illustration of a top view of the apparatus, whereas FIG. 5C depicts an example two-dimensional illustration of a side view of the apparatus.

As previously introduced, axis-adjusting bolt 200 can be coupled to laser housing 100, e.g., by way of pivot arm 300. Moreover, axis-adjusting bolt 200 can be configured to enable laser housing 100 to rotate 360 degrees along a tuning plane perpendicular to lateral axis 202 of axis-adjusting bolt 200. Hence, by enabling laser housing 100 to swivel 360 degrees, a laser beam can be adjusted to any distant point in a tuning plane that is perpendicular to lateral axis 202 and parallel to the xz-plane depicted on FIG. 5A. Moreover, once rotated to a desired angle, laser housing 100 can be locked in place by a set screw inserted to a set screw aperture of axis-adjusting bolt 200, e.g., by locking into place pivot arm 300.

As mounting frame 400 represents the component by which the apparatus can be mounted to an archery bow, mounting frame 400 can also include an aperture for mounting to the bow. In particular, mounting frame 400 can include a substantially arc-shaped mounting Slot 402, which can be adapted to enable an attachment means for attachment to a riser of an archery bow. In one or more aspect, the attachment means can be at least one of a bolt, a screw, a rod, a pin, and so forth, or combinations thereof.

Regardless of the attachment means utilized, arc-shaped mounting slot 402 can facilitate adjustable mounting to the archery bow based upon a location within the arc-shaped mounting slot 402 of the at least one attachment means. Moreover, in one or more aspect, arc-shaped mounting slot 402 can facilitate adjustable mounting to an archery bow based upon the location of the at least one attachment means and further based upon an arrangement of the mounting frame. Put another way, the apparatus depicted in FIGS. 5A-5C can be rotated in various directions prior to mounting to an archery bow such that laser housing 100 is situated either at a front or rear location of the bow, an upper or lower portion of the bow, and in a left or right portion with respect to the riser of the bow. Thus, the apparatus is suitable for use with respect to a large set of bow-bow sight combinations.

In particular and in regard to the various functions performed by the above described components, devices, apparatuses, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the embodiments. In this regard, it will also be recognized that the embodiments includes a system as well as a computer-readable medium having computer-executable instructions for performing the acts and/or events of the various methods.

In addition, while a particular feature may have been disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

What is claimed is:

1. An apparatus that facilitates archery bow sight tuning, comprising:

a laser barrel adapted to house a laser light device;

an axis-adjusting bolt coupled to the laser barrel; and a mounting frame coupled to the axis-adjusting bolt, wherein the mounting frame comprises a circular mounting slot.

2. The apparatus of claim 1, wherein the axis-adjusting bolt is threaded bolt.

3. The apparatus of claim 1, wherein the axis-adjusting bolt is adapted to enable the laser barrel to rotate 360 degrees along a tuning plane perpendicular to a lateral axis of the axis-adjusting bolt.

4. The apparatus of claim 1, further comprising a set screw associated with the axis-adjusting bolt, wherein the set screw is adapted to fix the laser barrel at a particular angle in the plane.

5. The apparatus of claim 1, wherein the circular mounting slot is substantially circular in shape.

6. The apparatus of claim 1, wherein the circular mounting slot spans at least 200 degrees of a substantially circular shape.

7. The apparatus of claim 1, wherein the circular mounting slot spans about 250 degrees of a substantially circular shape.

8. The apparatus of claim 1, wherein the circular mounting slot is adapted to enable an attachment means for attachment to a riser of an archery bow.

9. The apparatus of claim 8, wherein the attachment means is at least one of a bolt, a screw, a rod, or a pin.

10. The apparatus of claim 8, wherein the mounting frame is attached to the riser such that the laser barrel is situated at the rear or aft end of the archery bow.

11. The apparatus of claim 8, wherein the mounting frame is attached to the riser such that the laser barrel is situated at the front or fore end of the archery bow.

12. An apparatus that accommodates a wider variety of archery bow sights in connection with bow sight tuning, comprising:

a mounting frame of a laser tuning device comprising a substantially arc-shaped mounting slot, wherein the substantially arc-shaped mounting slot spans an arc of between 200 degrees and 300 degrees, and wherein the substantially arc-shaped mounting slot facilitates adjustable mounting to an archery bow based upon a location within the substantially arc-shaped mounting slot of at least one attachment means.

13. The apparatus of claim 12, further comprising an axis-adjusting bolt coupled to the mounting frame.

14. The apparatus of claim 13, further comprising a laser housing configured to accommodate a laser light device.

15. The apparatus of claim 14, wherein the axis-adjusting bolt is configured to enable the laser housing to rotate 360 degrees within a tuning plane perpendicular to a lateral axis of the axis-adjusting bolt.

16. The apparatus of claim 12, wherein the substantially arc-shaped mounting slot facilitates adjustable mounting to an archery bow based upon the location and further based upon an arrangement of the mounting frame.

17. An apparatus for accommodating a wider variety of archery bow sights in connection with bow sight tuning, comprising:

means for coupling a laser housing to an axis-adjusting rod, wherein the laser housing is configured to house a laser light device and the axis-adjusting rod is configured to enable the laser housing to swivel in a tuning plane perpendicular to a lateral axis of the axis-adjusting rod; and means for coupling the axis-adjusting rod to a mounting frame configured for mounting to a riser of an archery bow, wherein the mounting frame includes a substantially arc-shaped aperture for facilitating the mounting to the riser.

* * * * *